United States Patent [19]

Gerber

[11] 4,322,919

[45] Apr. 6, 1982

[54] SELF-CENTERING FEED MECHANISM FOR AN ABRASIVE GRINDING MACHINE

[75] Inventor: Dennis J. Gerber, Minneapolis, Minn.

[73] Assignee: Acrometal Products, Inc., Minneapolis, Minn.

[21] Appl. No.: 163,781

[22] Filed: Jun. 27, 1980

[51] Int. Cl.[3] ..... B24B 21/04

[52] U.S. Cl. ..... 51/139; 198/782

[58] Field of Search ..... 51/135 R, 135 BT, 139, 51/140, 148, 87 R, 97 NC, 39; 198/782, 791, 780

[56] References Cited

U.S. PATENT DOCUMENTS

| | | | |
|---|---|---|---|
| 1,804,537 | 5/1931 | Meacher | 51/87 R |
| 2,677,922 | 5/1954 | McGuire | 51/139 |
| 2,895,263 | 7/1959 | Reynolds | 51/139 |
| 2,958,989 | 11/1960 | Pendergast . | |
| 3,118,314 | 1/1964 | Schuster . | |
| 3,129,535 | 4/1964 | Slattery | 51/87 R X |
| 3,166,874 | 1/1965 | Bottcher | 51/87 |
| 3,269,065 | 8/1966 | Nylund . | |
| 3,339,319 | 9/1967 | Schuster . | |
| 3,566,546 | 3/1971 | Lindmark | 51/140 |
| 3,608,245 | 9/1971 | Fair . | |
| 3,701,219 | 10/1972 | Sternal | 51/140 |
| 3,708,817 | 1/1973 | Rhine . | |
| 3,724,517 | 4/1973 | Edwards . | |
| 3,782,044 | 1/1974 | Olin . | |
| 3,800,477 | 4/1974 | Jendrisak | 51/140 |
| 3,832,808 | 9/1974 | Kiser . | |
| 3,895,464 | 7/1975 | Kiser . | |
| 3,915,290 | 10/1975 | Zuercher . | |
| 4,178,721 | 12/1979 | Evans . | |

*Primary Examiner*—Harold D. Whitehead

*Attorney, Agent, or Firm*—Merchant, Gould, Smith, Edell, Welter & Schmidt

[57] ABSTRACT

The disclosure is directed to a self-centering feed apparatus for a dual head abrasive grinding machine. The grinding heads are mounted in opposed vertical relation, and workpieces are fed therebetween along a horizontal center line or plane. The self-centering feed apparatus comprises at least two sets of control arm mechanisms mounted above and below the center line. The control arm mechanisms of each set are mounted in side-by-side relation on a common pivot shaft, and are independently movable toward and away from the center line as the workpieces move through. Each mechanism includes a drive wheel for engaging the workpiece and driving it through the machine. Each control arm mechanism is urged toward the center line by a spring loaded pneumatic actuator that provides a constant gripping force, and which also generates a resistive force that increases as a function of deflection of a control arm mechanism from the center line. This causes the workpieces to self-center on the center line and insures that they will be uniformly surfaced on both sides even in the presence of warpage or variations in thickness.

46 Claims, 14 Drawing Figures

Fig. 1
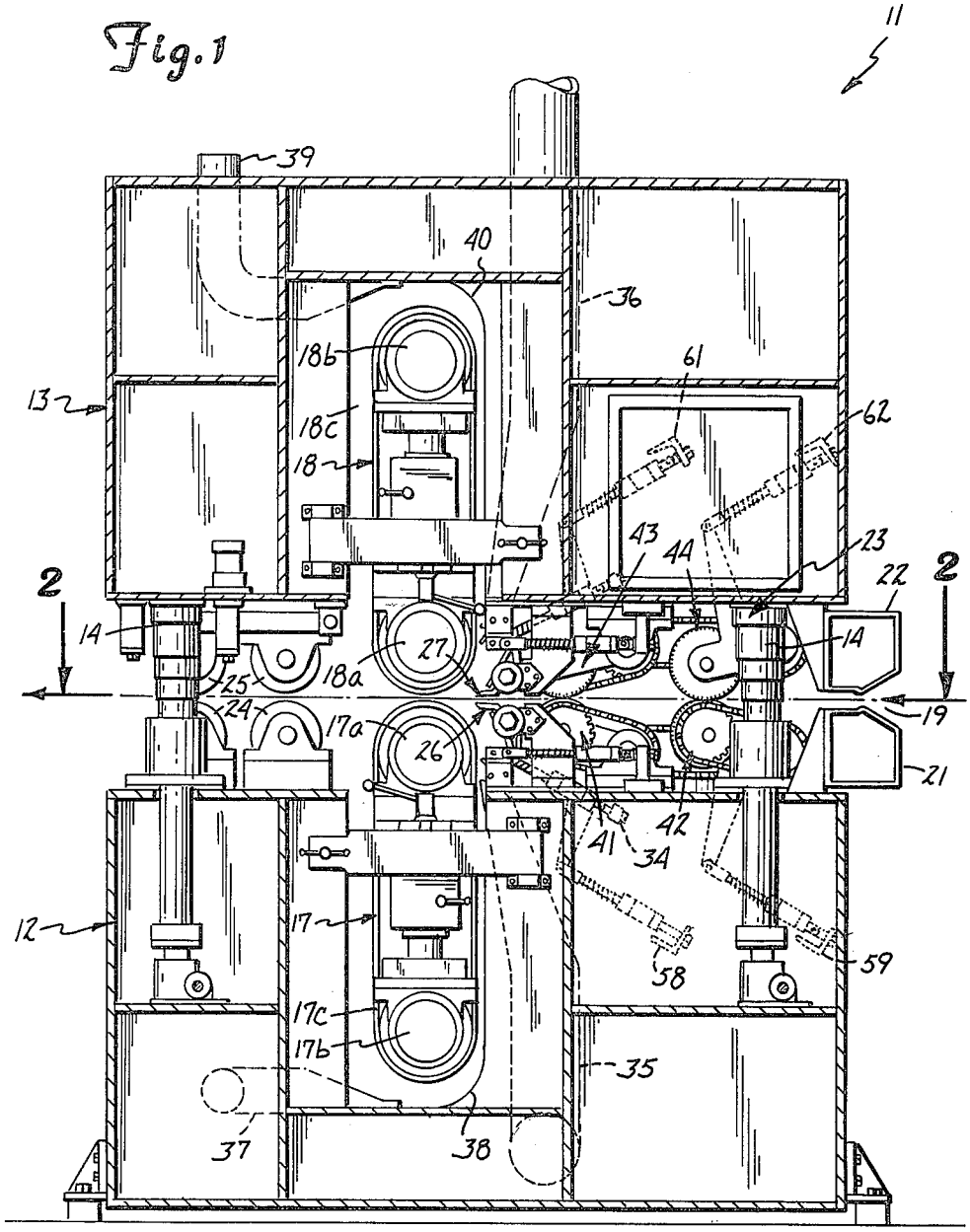
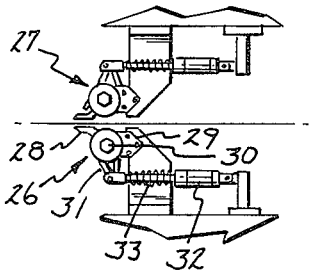
Fig. 1A

Fig. 5
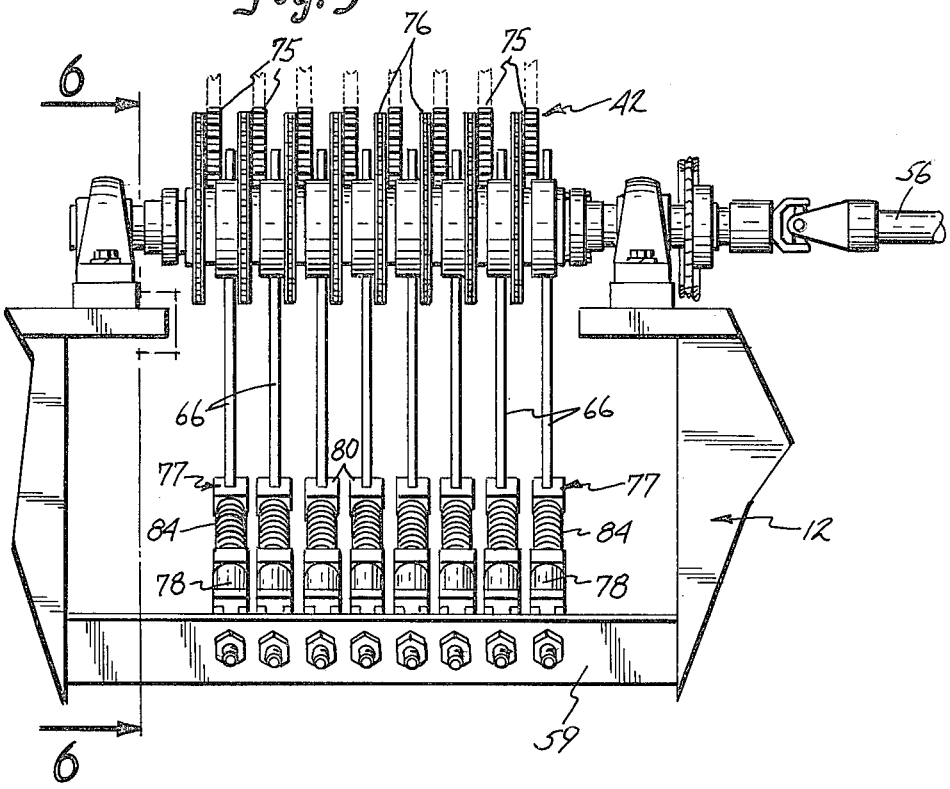
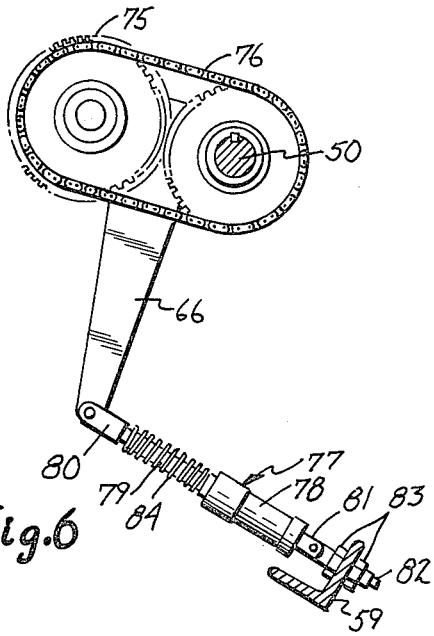
Fig. 6
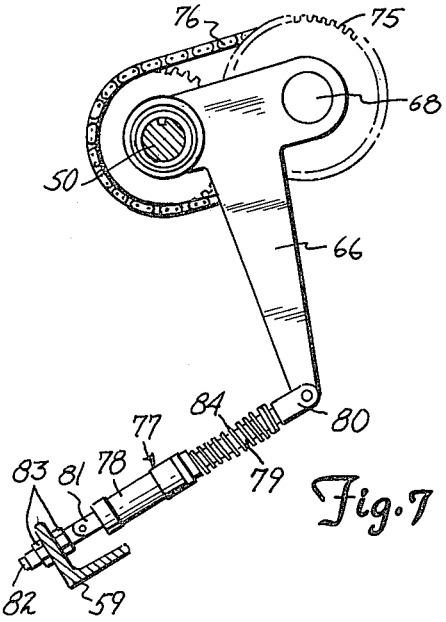
Fig. 7

SELF-CENTERING FEED MECHANISM FOR AN ABRASIVE GRINDING MACHINE

TECHNICAL FIELD

The invention is generally related to automatic feed mechanisms, and is specifically directed to a self-centering feed mechanism for a dual head abrasive grinding machine.

BACKGROUND OF THE INVENTION

Abrasive grinding and sanding machines are finding increased use in many areas where it is necessary to perform surface operations on workpieces. Machines of this type generally consist of one or more heads, each of which includes an endless abrasive belt moved at relatively high speed around driving and driven rollers. The abrasive belts and rollers may be relatively wide (i.e., on the order of several feet in width), and thus capable of surfacing workpieces of substantial width, such as plywood panels. These machines have many advantages over conventional surfacing apparatus, among them time and cost efficiency, better accuracy and safer operation.

One additional primary advantage is that two opposed heads may be provided for the abrasive grinding or sanding machine, which permits both surfaces of a workpiece to be processed simultaneously. Dual head wide belt sanding machines are now commonly used for surfacing and dimensional control for wood panels such as plywood. Spacing of the dual heads may be controlled to the closest thousandth of an inch, thus permitting extremely large panels to be quickly and efficiently surfaced with great accuracy. Abrasive sanding machines have also been used to a limited extent for dimension lumber, which is generally rough cut from softwood, and also for hardwood planks of various sizes. However, various problems have arisen because lumber of this type often is warped significantly, and also because it may vary significantly in thickness in rough cut form.

In dual head abrasive sanding machines, it is imperative that each workpiece be uniformly surfaced on both sides. Otherwise, the workpiece will be improperly surfaced, or not surfaced at all in some areas. In many cases, the resulting defective workpiece must be discarded. For rough cut dimension lumber that is warped in one way or another, or which varies in thickness in rough cut form, it is most difficult for the machine to accomplish its intended function even though the sanding heads are spaced apart a predetermined amount and rigidly held in this position.

For example, a length of dimension lumber which has a torsional warp about its longitudinal axis cannot pass between the sanding heads in a manner that causes each side to be uniformly surfaced. The warpage will cause excessive surfacing on one side and insufficient surfacing on the other in the areas of maximum warpage.

Some prior art machines have used rigid or fixed position rollers in feed mechanisms to force the warped lumber through the sanding heads in a manner which causes uniform surfacing. However, even though the length of lumber may be temporarily held in a non-warped position as it passes through the sanding heads, the best possible end result is a warped length of lumber having both sides surfaced. If the warp is particularly bad and there is no resiliency on the part of the feed system, it is often the case that the lumber will become cracked or split as it is forced to comply with the straight line form of the fixed roller feed system. In cases such as this, the lumber must be discarded.

This problem is compounded by workpieces that vary in thickness. In rigid feed systems, once the machine is adjusted to workpieces of a particular nominal thickness, a thinner piece may slip within the feed apparatus, or be guided and surfaced poorly, and thicker workpieces may be too large to enter the machine.

SUMMARY OF THE INVENTION

The invention resides in a feed mechanism for abrasive grinding machines that are capable of effectively surfacing one or both sides of workpieces that vary in thickness. The term "grinding" is used generically herein to include sanding as well as other surfacing operations.

The preferred embodiment is disclosed in connection with a dual head sanding machine in which the workpiece is passed between upper and lower sanding heads that are spaced apart an amount corresponding to the finished product thickness.

In use with a dual head sanding machine, the inventive self-centering feed apparatus comprises at least two sets of control arm mechanisms which are disposed in opposition above and below the desired center line of movement of the workpiece. In this regard, the center line of movement refers to an axis of symmetry for the feed apparatus and sanding heads, and is representative of the line of symmetry through which the workpiece would move if it were to be surfaced identically by each sanding head. If the line is generated or projected laterally over the width of the feed mechanism and sanding heads, it becomes a plane of symmetry.

The preferred embodiment includes four sets of control arm mechanisms that are arranged in opposed set-pairs. The control arm mechanisms in each set are arranged in side-by-side relation, and independently pivot about a common axis toward and away from the center line or plane. Each is individually urged to a position of engagement by a pneumatic actuator that permits the control arm mechanism to be deflected away from the center line or plane as it engages the workpiece, but which maintains a constant gripping force on the workpiece through the supply of air at regulated pressure. The pneumatic actuator is also provided with a coil spring that is compressed as the control arm mechanism is deflected away from the center line or plane, and which generates a reactive force that is directly proportional or linear with the deflection.

The constant force of the actuator operating under regulated pressure provides gripping at a desired magnitude. The variable reactive spring force provides a self-centering function, by reacting with increasing force to deflections of the control arm mechanism due to warpage or the like. It will be appreciated that this proportional spring force reacts in a manner that maintains the workpiece in its proper orientation relative to the center line or plane.

Because the control arm mechanisms of each set are arranged in side-by-side relation but at the same time operate independently, they collectively follow the contour of the board, urging it into the center line position. They do not flatten the board, as is the case with rigid or fixed position rollers, and thus avoid splitting and the resulting decrease in yield.

The driving element of each of the control arm mechanisms is a drive wheel that in the preferred embodiment takes the form of a spur gear. The spur gear is particularly beneficial because its teeth are disposed perpendicularly to the line of workpiece travel, and prevent any possible slippage of the workpiece, notwithstanding warpage or variations in thickness.

As described, the inventive feed apparatus firmly grips each workpiece, causes it to self-center for uniform surfacing on both sides, and guides it through the sanding heads quickly and efficiently. The result is uniformity of end products and increased yield.

In addition to uniformly and identically surfacing each side of the workpiece, it has also been found that warped workpieces handled by the self-centering feed apparatus are actually dewarped by the process. The precise reason for this phenomenon is not known, but it is believed that surfacing a warped workpiece while being urged to a nonwarped condition releases certain of the warping forces in the surface grain. The end result is workpieces that are uniformly surfaced and significantly dewarped.

It is to be understand that the inventive feed apparatus may be used with grinding machines other than the dual sanding head type. For example, the feed apparatus may also be effectively used with a single head machine, in which case it would specifically comprise one set of control arm mechanisms disposed in side-by-side relation and pivotable about a common axis, and biased by individual spring-loaded pneumatic actuators.

Other features and advantages of the invention will become apparent from the drawings and following description.

BRIEF DESCRIPTION OF THE DRAWINGS

FIG. 1 is a sectional view of an abrasive grinding machine embodying the invention in side elevation with reference to a vertical plane passing entirely through the machine;

FIG. 1A is a fragmentary view of portions of the machine as shown in FIG. 1 and relating to dust removal, with other components removed for clarity;

FIG. 5 is an enlarged fragmentary view in end elevation of one set or gang of control arm mechanisms, showing in particular the manner of mounting to the frame and the common drive;

FIG. 6 is a sectional view of one of the control arm mechanisms taken along the line 6—6 of FIG. 5;

FIG. 7 is a view of the control arm mechanism of FIG. 6 taken from the opposite side thereof;

DESCRIPTION OF THE PREFERRED EMBODIMENT

Figure 3:
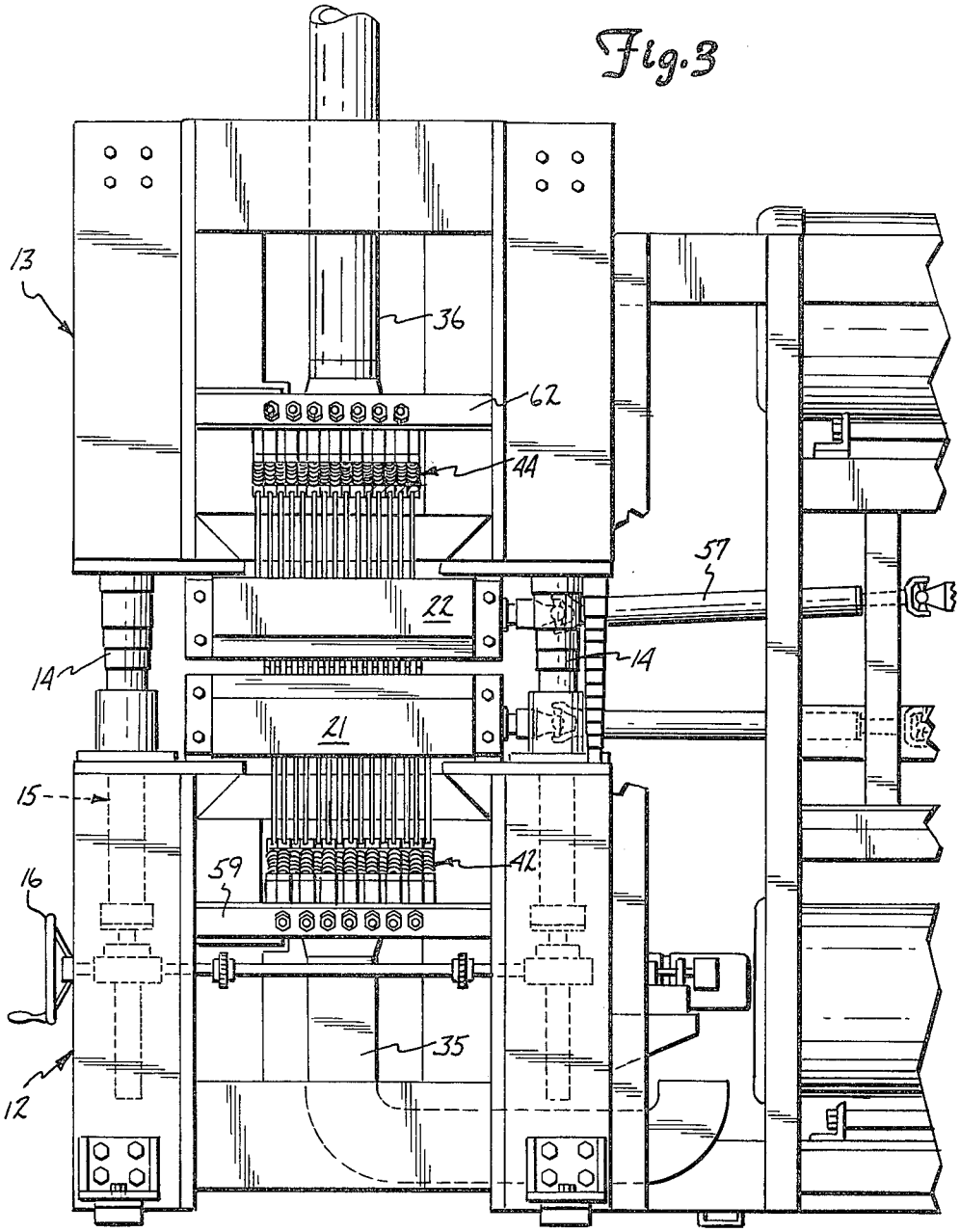
FIG. 3 is a fragmentary sectional view of the abrasive grinding machine from the infeed end with respect to a vertical plane passing transversely through the machine.

With initial reference to FIGS. 1 and 3, an abrasive grinding machine embodying the inventive principal is represented generally by the numeral 11. The machine comprises a lower frame 12 and an upper frame 13, the latter of which is carried by four vertical, telescoping columns 14 for vertical adjustment. An adjustment mechanism represented generally by the numeral 15 is commonly connected to each of the telescoping columns 14 as known in the art, and is controlled by a single adjustment wheel 16.

Lower and upper sanding heads 17, 18 are respectively carried by the lower and upper frames 12, 13. Both of the sanding heads 17, 18 are vertically oriented, and they are spaced apart by an amount which corresponds to the desired end thickness of the articles to be abrasively ground. This spacing is controlled by the adjustment wheel 16.

As is known in the art, the lower sanding head 17 comprises a drive roller **17*a* driven conventionally by a motor not shown, an idler roller 17*b*, and an endless abrasive belt 17*c* which is wider than the lateral dimension of the articles to be ground. Similarly, the sanding head 18 comprises a drive roller 18*a* mounted in opposition to the drive roller 17*a*, an idler roller 18*b* and an endless abrasive belt 18*c***.

The infeed area for articles to be ground is a lateral opening 19 defined by a lower, laterally extending member 21 which is generally box-shape in cross section and is secured to the lower frame 12. An upper member 22 is a mirror image of the member 21, and is secured to the upper frame 13.

Disposed between the infeed opening 19 and the sanding heads 17, 18 is an inventive, self-centering feed mechanism 23, which is described in greater detail below.

On the opposite or downstream side of the sanding heads 17, 18 are lower and upper sets of outfeed rolls 24, 25 which are respectively mounted to the lower and upper frames 12, 13. The outfeed rolls 24, 25 are arranged in opposed pairs, and are vertically spaced an amount which is slightly less than the desired finish thickness of the articles which are ground. The outfeed rolls 24, 25 have outer surfaces which are resilient, and they serve to smoothly grasp and guide the finished articles from the machine 11.

With reference to FIG. 1A, lower and upper dust shoes 26, 27 are disposed between the self-centering feed mechanism 23 and the sanding heads 17, 18. The dust shoes 26, 27 are of identical construction, although mirror images of each other, and a description of dust shoe 26 is exemplary.

Dust shoe 26 comprises a shoe member 28 that is substantially horizontally disposed and extends the entire width of the sanding head 17. The shoe member 28 is carried at each end by a support 29 that permits pivotal movement about a pivot point 30. A weldment 31 is rigidly secured to the shoe member 28 and support 29, projecting angularly below the latter. The lower end of the weldment 31 is pivotally connected to the extensible rod of a pneumatic actuator 32 that, like the support 29, is secured to the lower frame 12. Pneumatic actuator 32 is horizontally disposed, and in its operative state normally urges the dust shoe 28 to the position shown in FIG. 1. The function of pneumatic actuator 32 is assisted by a coil spring 33 that offers a linear resistive force to deflection of the shoe member 28 as the workpieces pass through to the sanding heads 17, 18.

The pneumatic actuator 32 is connected to one end of the weldment 31. At the opposite end is a pneumatic actuator 34 (shown in phantom in FIG. 1), that is angularly disposed relative to the actuator 32 because of space limitations at the opposite end of the dust shoe 26.

With the dust shoes 26, 27 normally urged together as shown in FIG. 1, the workpiece frictionally slides between them, thus blocking the reverse flow of dust generated by the sanding heads 17, 18 as the workpieces pass therethrough. As is typical on machines of this type, the drive rollers 17*a*, 18*a* of the sanding heads rotate against forward movement of the workpiece, which tends to force dust in a direction opposite workpiece movement. However, due to the shape of the dust shoes 26, 27 and the fact that they are urged into engagement with the workpieces, the dust resulting from the grinding operation is directed downward by the dust shoe 26 and upward by the dust shoe 27 for collection and removal. This is facilitated by a dust removal duct 35 that is vertically disposed immediately rearward of the sanding head 17, and the mouth of which is disposed adjacent the drive roller 17*a*. A similar dust removal duct 36 is provided for the sanding head 18.

The dust collection system also includes a dust removal duct 37 that is horizontally disposed and has an inlet positioned relative to the idler roller 17*b* for tangential collection of dust not collected by the duct 35. This dust is guided into the duct 37 by a sheet metal panel 38 that is positioned just behind the sanding head 17 and below the inlet of duct 35, and which curves into the inlet of duct 37. A similar dust removal duct 39 and sheet metal panel 40 are provided for the upper sanding head 18.

The dust removal ducts 35–37 and 39 are commonly connected to a source of vacuum and collector, as is known in the art.

The self-centering feed mechanism 23 is shown in FIGS. 1–7, to which reference is made.

In the preferred embodiment, the self-centering feed mechanism 23 comprises four sets or gangs 41–44 of separate, independently operable control arm mechanisms 45. The sets 41, 42 are carried by the lower frame 12 in underlying relation to the workpiece, and the sets 43, 44 are carried by the upper frame 13 in overlying relation to the workpieces. The sets 41, 43 are disposed in opposed relation about an axis of symmetry 46 that is also the center line of the workpieces as they pass through the machine. The sets 43, 44 are similarly disposed in opposition.

Figure 2:
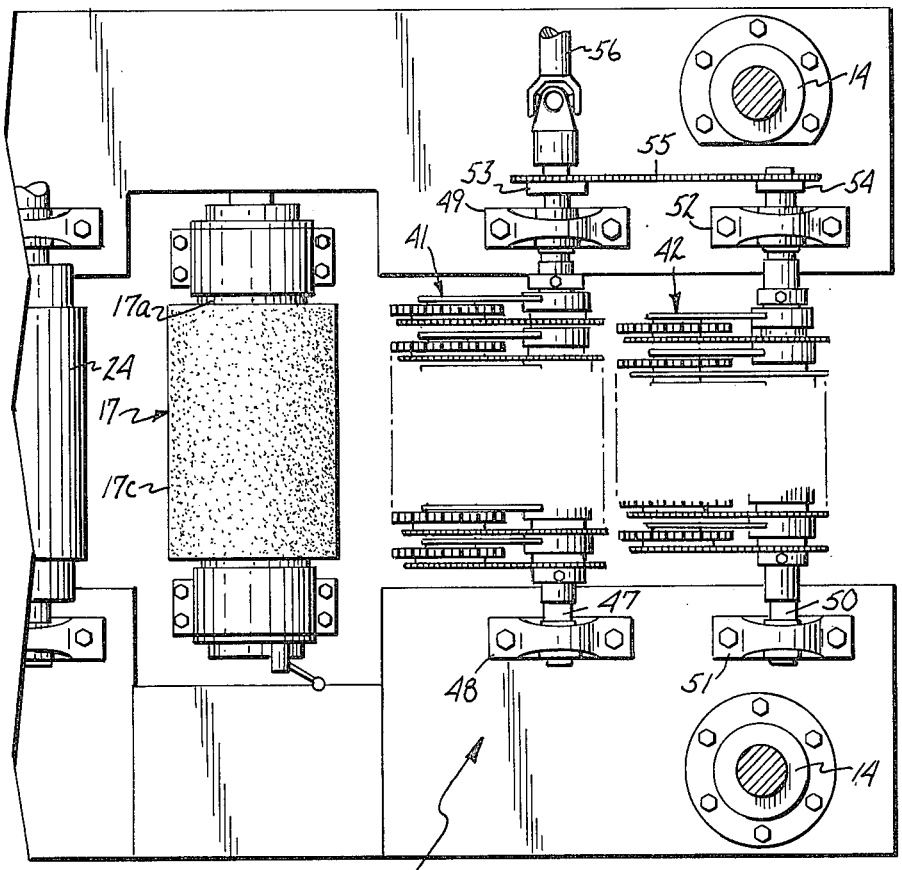
FIG. 2 is an enlarged, fragmentary sectional view of the abrasive grinding machine taken along the line 2—2 of FIG. 1, with portions thereof removed for purposes of clarity, and showing in particular two sets or gangs of control arms that together make up a self-centering feed for the machine.

With reference to FIG. 2, the set 41 comprises a pivot shaft 47 rotatably supported by spaced bearings 48, 49 each of which is mounted to the lower frame 12. In the preferred embodiment, there are eight control arm mechanisms 45 in each of the sets 41–44, and each of these mechanisms is individually mounted on the pivot shaft 47 in a manner described in greater detail below. The set 42 includes an identical pivot shaft 50 journaled in a pair of bearings 51, 52.

Pivot shaft 47 has a sprocket 53 mounted at its right end as viewed in FIG. 2, and pivot shaft 50 has a sprocket 54 mounted at its right end in alignment with sprocket 53. A chain 55 interconnects the two.

A drive shaft 56 is universally connected at one end to the pivot shaft 47 and at its other end to an electric motor (not shown).

With brief reference to FIG. 3, the upper sets 43, 44 of control arm mechanisms are commonly driven in a similar manner by a drive shaft 57.

With reference to FIGS. 1, 3 and 5–7, the lower frame member 12 comprises a pair of cross braces 58, 59 disposed in parallel, spaced relation below the sets 41, 42, respectively. The upper frame 13 includes a like pair of cross braces 61, 62 that are respectively mounted in overlying relation to the sets 43, 44. These cross braces are L-shaped in cross section, and each serves as a common mount for its plurality of control arm mechanisms 45.

Figure 4:
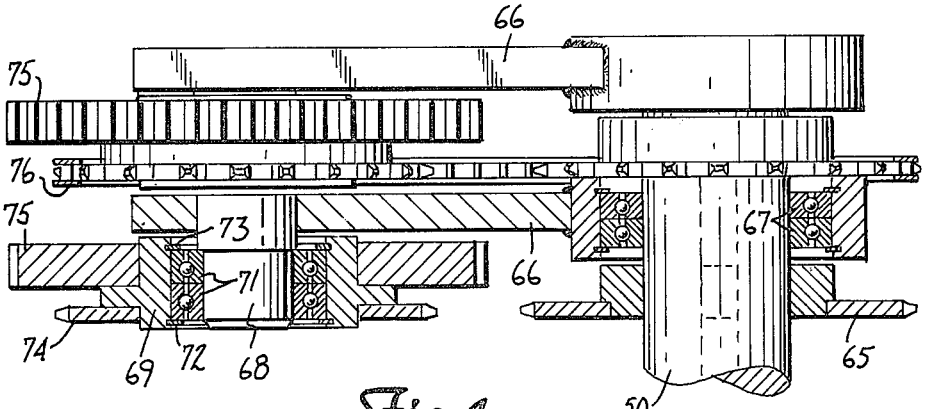
FIG. 4 is an enlarged view in top elevation of two of the control arm mechanisms, one of which is shown in section.

FIGS. 4, 6 and 7 show the specific construction of each control arm mechanism 45. The description is relative to set 42 only, but is exemplary for the other sets 41, 43 and 44.

A drive sprocket 65 is mounted for rotation on the pivot shaft 50. Axially adjacent the sprocket 65 is a control arm 66, that is carried on the pivot shaft 50 by a set of bearings 67, permitting the shaft 50 to rotate relative to the arm 66 and also permitting the arm 66 to pivot relative to the shaft 50. As best shown in FIG. 7, the control arm 66 is substantially T-shaped, and the pivot shaft 50 passes through one of its lateral extensions.

The opposite lateral extension of the T-shaped control arm 66 carries a stub shaft 68 that extends axially in parallel relation to the pivot shaft 50. A hub 69 having a peripheral flange 69*a* is mounted for rotational movement relative to the stub shaft 68 by a bearing set 71 held in place by a pair of lock rings 72, 73.

A driven sprocket 74 is secured to the hub 69 on one side of the flange 69*a* in engagement therewith. Sprocket 74 is disposed in alignment with the drive sprocket 65. A spur gear 75 is secured to the hub 69 on the opposite side of the flange 69*a* from sprocket 74. As constructed, the hub 69, driven sprocket 74 and spur gear 75 rotate together relative to the stub shaft 68 in an idling manner.

A chain 76 (shown only on the right-hand control arm mechanism 45 in FIG. 4) connects the drive and driven sprockets 65, 74, and as the pivot shaft 50 is rotated by the motor, each driven sprocket 74 and spur gear 75 is likewise rotatably driven.

Each of the spur gears 75 serves as a drive wheel to the workpieces, and its diameter is therefore necessarily larger than the driven sprocket 74 with the added radial dimension of the chain (FIG. 4).

With specific reference to FIGS. 5–7, each of the control arm mechanisms 45 further comprises a pneumatic actuator 77 including a cylinder 78, an extensible rod 79, a forward pivot link 80 and a rear pivot link 81.

The forward pivot link 80 is pivotally connected to the downward extension of the T-shaped control arm 66. The rear pivot link 81 is pivotally connected to a threaded stub shaft 82 that projects through one of a row of bores in the cross brace 59 and secured by a pair of lock nuts 83.

A coil spring 84 is mounted in compression on the extensible rod 79 between the forward pivot link 80 and the cylinder 78.

The pneumatic actuators 77 of each of the sets 41–44 are commonly connected to a source of regulated air pressure (not shown) that is variably controlled in order for the pneumatic cylinders 78 to generate a resistive force of predetermined magnitude.

Since air is compressible, any load on the control arm mechanism 45, as created by a workpiece as it is engaged and driven by the associated spur gear 75, will cause the retraction of the rod 80 due to the load force acting through the control arm 66 relative to the pivot shaft 50. Because the cylinders 78 are supplied by a regulated source, however, the force of the cylinder 78 on the rod 80 is substantially constant throughout its range of movement for varying loads.

However, as the spring 83 is compressed by engagement of the spur gear 75 by the workpiece and retraction of the rod 79, it generates a force which linearly increases as a direct function of the amount of deflection of control arm 66. Consequently, as a workpiece is engaged and driven by one of the spur gears 75, the resulting deflection of the control arm mechanism 45 is met with a resistive force equal to the linearly variable spring force superimposed on the constant cylinder force.

In the operation of each of the control arm mechanisms 45, it is the constant force generated by the pneumatic cylinder 78 acting through the rod 79, control arm 66 and spur gear 75 that permits the spur gear 75 to properly grip the workpiece. The presence of the spring 83, in resisting control arm deflection with a linearly increasing force, results in a self-centering function that insures uniformity in the surfacing of the workpiece notwithstanding the defects it may have due to warping or variations in its thickness.

As described, it will be appreciated that the control arm mechanisms 45 of each of the sets 41–45 are commonly driven in order for the workpiece to be moved ahead in the desired manner. In addition, however, the control arm mechanisms of each set independently pivot about the associated pivot shaft without interrupting the driving movement of the spur gears 75, thus permitting the control arm mechanisms to closely follow the contour of the workpiece, notwithstanding variations in its thickness or the degree and manner of its warpage.

To facilitate this ability to follow the workpiece contours while maintaining forward movement, in the preferred embodiment the control arm mechanisms of the set 41 are staggered laterally relative to the control arm mechanisms of the set. This is best seen in FIGS. 2 and 3. The mechanisms of set 43 and 44 are staggered similarly.

Figure 8:
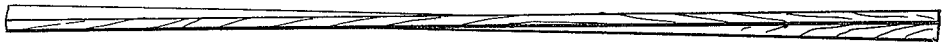
FIG. 8 is a view in side elevation of a length of dimension lumber having a torsional defect.
Figure 9:
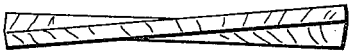
FIG. 9 is an end view of the dimension lumber of FIG. 8.
Figure 10:
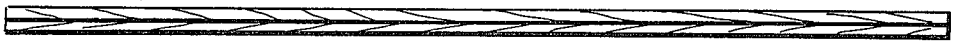
FIG. 10 is a view in side elevation of a length of dimension lumber having a cupped defect.
Figure 11:
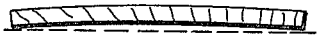
FIG. 11 is an end view of the dimension lumber of FIG. 10.
Figure 12:
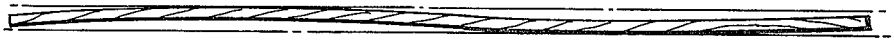
FIG. 12 is a view in side elevation of a length of dimension lumber which is defective both with respect to torsional and longitudinal warping.
Figure 13:
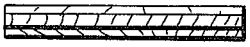
FIG. 13 is an end view of the dimension lumber of FIG. 12.

FIGS. 1–13 show typical defects in dimension lumber. In FIGS. 8 and 9, a 1×10 of pine or fir is shown with a torsional warp about its longitudinal axis. In FIGS. 10 and 11, the 1×10 is cupped; i.e., its lower surface is concave and its upper surface convex relative to its longitudinal axis. In FIGS. 12 and 13, the 1×10 is warped in a first direction about a first transverse axis and in the opposite direction about a second transverse axis. In essence, this double warpage causes the 1×10 to take the form of a reverse S.

In operation, the pneumatic actuators in the control arm mechanisms of the lower sets 41, 42 are provided with a slightly greater pressure than those of the sets 43, 44 because they must react to the weight of the workpiece in addition to the forces created by deflection.

Before workpieces are fed, adjustment to the spacing between sanding heads 17, 18 is made by the adjustment wheel 16. The spacial distance is determined as a function of the type of workpiece material (e.g., hardwood or softwood, dimension lumber or panels, etc.) and the process to be accomplished, (e.g., finish surfacing or material removal to a desired thickness).

With the pneumatic actuators of the control arm mechanism sets 41–44 set at a desired level, and also with the pneumatic actuators for the dust shoes 26, 27 properly set, workpieces are fed through the infeed opening 19 to the self-centering feed mechanism 23. The workpiece will be initially engaged by control arm mechanisms from the sets 42, 44, the number depending on the width of the workpiece. Because the control arm mechanisms of each of the sets 41–44 pivot individually on the associated pivot shaft, they operate separately and independently. Consequently, there is deflection of only those control arm mechanisms that are actually engaged by the workpiece, and the contour of the workpiece is followed by the feed apparatus in a precise manner.

The spur gears 75 of the affected control arm mechanisms engage and grip the workpiece, moving it forward to the sets 41, 43. As the workpiece is engaged and gripped, the affected spur gears 75 are deflected laterally away from the center line 46. However, the pressure acting through the pneumatic actuators 77 retains the grip, and forward movement continues with rotation of the spur gears 75. In addition, deflection of the spur gears by the moving workpiece is also resisted by the coil springs 84. The resistive spring forces, which are directly proportional to the amount of deflection, tend to maintain the workpiece on the center line 46 so that, when the workpiece reaches the sanding heads 17, 18, the same surfacing operation will be uniformly carried out on both sides.

It has also been found that utilization of a self-centering feed mechanism of this type in conjunction with the abrasive grinding operation actually serves to dewarp defective workpieces. It is not fully understood why this phenomenon takes place, although it is believed possibly to be the result of release of the warpage forces in the surface grain of the workpiece as it is held in a proper position along the center line 46 at the time that uniform abrasive grinding takes place identically on both sides. The result then is not only uniformly surfaced on both sides, but also a workpiece that is substantially dewarped.

What is claimed is:

1. Self-centering feed apparatus for an abrasive grinding machine having upper and lower sanding heads between which a center line extends along which workpieces are moved, the self-centering feed apparatus comprising first and second guide means disposed in opposed relation above and below the center line, each of said guide means comprising:

(a) a plurality of independently operable control arm mechanisms disposed in side-by-side relation;

(b) pivot means for supporting said plurality of control arm mechanisms for independent pivotal movement about a common pivot axis;

(c) each of said control arm mechanisms comprising (i) a control arm pivotally mounted on said pivot means for movement toward and away from said center line:

(ii) workpiece drive means mounted on the control arm remote from the pivot means for engagably driving the workpiece along the center line;

(iii) first biasing means for resiliently urging the control arm and workpiece drive means toward the center line under a substantially constant force;

(iv) and second biasing means for resiliently urging the control arm and workpiece drive means toward the center line under a force that increases as a function of the amount of movement of a control arm away from the center line by a workpiece.

2. The apparatus defined by claim 1, wherein the first biasing means comprises a pneumatic actuator and means for commonly supplying air under substantially constant pressure to the control arm mechanisms of each guide means.

3. The apparatus defined by claim 2, wherein each pneumatic actuator comprises a pneumatic cylinder and an extensible rod connected to the control arm, and a second biasing means comprises a spring mounted on the extensible rod between the pneumatic cylinder and control arm.

4. The apparatus defined by claim 1, wherein the second biasing means comprises spring means.

5. The apparatus defined by claim 1, wherein the pivot means comprises a pivot shaft disposed transversely of the line of workpiece movement.

6. The apparatus defined by claim 5, wherein:

(a) the control arm of each guide means are mounted on the pivot shaft for relative movement thereto;

(b) and the drive means comprises (i) a drive wheel mounted for rotation on the control arms;

(ii) means for rotating the pivot shaft;

(iii) and means for operatively connecting the drive wheel and the pivot shaft.

7. The apparatus defined by claim 6, wherein the means for operatively connecting the drive wheel and the pivot shaft comprises:

(a) a first sprocket of lesser diameter than the drive wheel and mounted for rotation therewith;

(b) a second sprocket mounted for rotation with the pivot shaft;

(c) and a chain connecting the first and second sprockets.

8. The apparatus defined by claim 7, wherein the control arm is substantially T-shaped, defining first and second lateral extensions and a downwardly extending leg, the drive wheel and first sprocket being mounted on the first lateral extension, the pivot shaft extending through the second lateral extension, and the first and second biasing means being operatively connected to the downwardly extending leg.

9. The apparatus defined by claim 8, wherein the first biasing means comprises a pneumatic actuator including a pneumatic cylinder and an extensible rod connected to the downward extending leg.

10. The apparatus defined by claim 9, wherein the second biasing means comprises a coil spring mounted on the extensible rod between the pneumatic cylinder and the downwardly extending leg.

11. The apparatus defined by claim 6, wherein the drive wheel comprises a spur gear.

12. The apparatus defined by claim 1, which further comprises third and fourth guide means disposed in opposed relation above and below the center line, respectively, and each comprising a plurality of said independently operable control arm mechanisms disposed in side-by-side relation and mounted on pivot means for independent pivotal movement about a common pivot axis.

13. The apparatus defined by claim 12, wherein the control arm mechanisms of the third and fourth guide means are laterally staggered on the associated pivot means relative to the first and second guide means, respectively.

14. An abrasive grinding machine comprising:

(a) frame means;

(b) upper and lower grinding heads carried by the frame means above and below a reference plane along which workpieces may be moved, the grinding heads being constructed and arranged to cooperatively surface opposite sides of a workpiece as it passes therebetween;

(c) self-centering feed apparatus comprising (i) upper and lower sets of control arm means carried by the frame means above and below said reference plane;

(ii) and pivot means for carrying the control arm means of each set in side-by-side relation for independent pivotal movement about a common pivot axis;

(iii) each of said control means comprising a control arm pivotally mounted on said pivot means for movement toward and away from said reference plane;

workpiece drive means mounted on the control arm remote from the pivot means for engageably driving the workpiece along the center line;

first biasing means for resiliently urging the control arm and workpiece drive means toward the reference plane under a substantially constant force; and second biasing means for resiliently urging the control arm and workpiece drive means toward the reference plane under a force that increases as a function of movement of the control arm away from the reference plane by a workpiece.

15. The apparatus defined by claim 14, wherein the first biasing means comprises a pneumatic actuator.

16. The apparatus defined by claim 15, wherein each pneumatic actuator comprises a pneumatic cylinder and an extensible rod connected to the control arm, and the second biasing means comprises a spring mounted on the extensible rod between the pneumatic cylinder and control arm.

17. Apparatus for feeding workpieces along a reference plane, comprising:

(a) a plurality of control arm means;

(b) pivot means for supporting the control arm means in side-by-side relation for independent pivotal movement about a common pivot axis;

(c) drive means associated with each of said control arm means for engaging and driving the workpieces along said reference plane;

(d) first biasing means for resiliently urging the control arm means and drive means toward the reference plane under a substantially constant force;

(e) and second biasing means for resiliently urging the control arm means and drive means toward the reference plane under a force that increases as a function of control arm means movement away from the reference plane by a workpiece.

18. The apparatus defined by claim 17, wherein the first biasing means comprises a pneumatic actuator.

19. The apparatus defined by claim 17, wherein the second biasing means comprises spring means.

20. Apparatus for feeding workpieces along a reference line, comprising:

(a) at least one control arm means;

(b) pivot means for supporting the control arm means for pivotal movement about a predetermined axis;

(c) drive means associated with the control arm means for engaging and driving the workpieces along said reference line;

(d) first means for resiliently urging the control arm means and drive means toward the reference line under a force that increases as a function of control arm means movement away from the reference line by a workpiece;

(e) and second biasing means for resiliently urging the control arm means and drive means toward the reference line under a substantially constant force.

21. Apparatus for feeding workpieces along a reference line, comprising:

(a) at least one control arm means;

(b) pivot means for supporting the control arm means for pivotal movement about a predetermined axis;

(c) first means for urging the control arm means toward the reference line under a substantially constant force;

(d) and second means for resiliently urging the control arm means toward the reference line under a force that increases as a function of control arm means movement away from the reference line by a workpiece.

22. Apparatus for guiding infed workpieces along a reference plane, comprising:

(a) a plurality of control arm means disposed in side-by-side relation;

(b) pivot means for supporting each of the control arm means for independent pivotal movement about an axis that traverses the line of workpiece movement;

(c) first means for urging the control arm means toward the reference plane under a substantially constant force;

(d) and second means for resiliently urging the control arm means toward the reference plane under a force that increases as a function of control arm means movement away from the reference plane by a workpiece.

23. The apparatus defined by claim 22, which further comprises drive means associated with each of said control arm means for engaging and driving the workpieces along said reference plane.

24. The apparatus defined by claim 22, wherein the substantially constant force of said first means is adjustable.

25. The apparatus defined by claim 22, wherein the first means comprises a fluid actuator operatively connected to each of the control arm means.

26. The apparatus defined by claim 25, wherein the fluid actuators are commonly pressurized by a source of regulated air pressure.

27. The apparatus defined by claim 25, wherein the second means comprises spring means.

28. The apparatus defined by claim 25, wherein each fluid actuator comprises a pneumatic cylinder and an extensible rod connected to the control arm means, and the second means comprises a spring compressibly mounted between the pneumatic cylinder and the control arm means.

29. The apparatus defined by claim 28, wherein:

(a) each control arm means comprises an integral control arm pivotally connected to the pivot means at a predetermined point in bell-crank fashion;

(b) the extensible rod is operably connected to the control arm on one side of said predetermined point;

(c) and further comprising workpiece engaging means operably connected to the control arm on the opposite side of said predetermined point.

30. The apparatus defined by claim 29, wherein each of the workpiece engaging means comprises drive means for driving the workpieces along said reference plane.

31. The apparatus defined by claim 30, which further comprises means for commonly driving the drive means.

32. The apparatus defined by claim 31, wherein the drive means comprises a spur gear.

33. The apparatus defined by claim 22, wherein the second means comprises spring means.

34. The apparatus defined by claim 22, wherein the pivot means are constructed and arranged to support the control arm means about a common pivot axis that is substantially perpendicular to the line of workpiece movement.

35. Apparatus for guiding infed workpieces along a reference plane, comprising:

(a) a plurality of control arm means disposed in side-by-side relation;

(b) means for supporting the control arm means for independent movement toward and away from the line of workpiece movement;

(c) first means for urging the control arm means toward the reference plane under a substantially constant force;

(d) and second means for resiliently urging the control arm means toward the reference plane under a force that increases as a function of control arm means movement away from the reference plane by a workpiece.

36. The apparatus defined by claim 35, which further comprises drive means associated with each of the control arm means for engaging and driving the workpieces along said reference plane.

37. The apparatus defined by claim 36, which further comprises means for commonly driving the drive means.

38. The apparatus defined by claim 35, wherein the independent movement of said plurality of control arm means is about a common pivot axis.

39. Apparatus for guiding infed workpieces along a reference plane, comprising:

(a) a plurality of control arm means disposed in side-by-side relation;

(b) pivot means for supporting each of the control arm means for independent pivotal movement about a common axis that traverses the line of workpiece movement;

(c) drive means for driving the workpieces along said reference plane;

(d) and biasing means for independently and resiliently urging each of the control arm means toward the reference plane under a predetermined force.

40. The apparatus defined by claim 39, wherein the biasing means is constructed and arranged to independently and resiliently urge each control arm means toward the reference plane under a first force that is substantially constant and a second force that increases as a function of control arm means movement away from the reference plane.

41. The apparatus defined by claim 39, wherein the drive means are operatively carried by the respective control arm means.

42. The apparatus defined by claim 39, wherein the drive means are commonly driven.

43. A device for use in apparatus for feeding workpieces along a reference line, comprising:

(a) control arm means of predetermined configuration constructed for pivotal mounting about an axis for pivotal movement toward and away from the reference line;

(b) workpiece engaging means associated with the control arm means for guidably engaging a workpiece as it moves along the reference line;

(c) first biasing means for resiliently urging the control arm means toward the reference line under a substantially constant force;

(d) and second biasing means for resiliently urging the control arm means toward the reference line under a force that increases as a function of control arm means movement away from the reference line by a workpiece.

44. The apparatus defined by claim 43, wherein the first biasing means comprises a fluid actuator operatively connected to the control arm means.

45. The apparatus defined by claim 43, wherein the second biasing means comprises spring means.

46. The apparatus defined by claim 43, wherein the first biasing means comprises a fluid actuator having an extensible rod operatively connected to the control arm means, and the second biasing means comprises a spring encircling the extensible rod and compressably mounted between the fluid actuator and control arm means.

* * * * *